United States Patent [19]

Kimura

[11] 4,333,262

[45] Jun. 8, 1982

[54] SOLAR POWERED TOY

[76] Inventor: Akira Kimura, 595 Broadway #2, New York, N.Y. 10012

[21] Appl. No.: 203,279

[22] Filed: Nov. 3, 1980

[51] Int. Cl.[3] ..... A63H 11/00; A63H 33/26

[52] U.S. Cl. ..... 46/266; 46/248; 46/256; 40/473

[58] Field of Search ..... 46/1 R, 248, 29, 264, 46/269, 266, 265, 45, 256; 272/8 N, 8 R, 27 N, 8 N; 40/473, 474, 475

[56] References Cited

U.S. PATENT DOCUMENTS

| | | | |
|---|---|---|---|
| 1,577,903 | 3/1926 | Gover et al. | 46/264 |
| 3,181,270 | 5/1965 | Trevena | 280/1.182 |
| 3,490,172 | 1/1970 | Schwartz | 46/264 |
| 3,597,872 | 8/1971 | Vennola et al. | 46/1 R |
| 4,090,715 | 5/1978 | Wagner et al. | 273/141 A |
| 4,182,077 | 1/1980 | Wagner et al. | 46/248 |
| 4,199,894 | 4/1980 | Fischer | 46/17 |
| 4,227,327 | 10/1980 | Thompson | 40/473 |
| 4,232,473 | 11/1980 | Jenkins | 46/1 R |

*Primary Examiner*—Robert Peshock
*Assistant Examiner*—Michael J. Foycik
*Attorney, Agent, or Firm*—Lyon & Lyon

[57] ABSTRACT

A solar powered toy has a plurality of legs each with angularly related sections connected together. Certain of the sections are mounted for relative turning movement, and electric motors powered by solar cells are mounted to turn adjacent sections of the legs, so that movements of the legs of the device change the degree of exposure of the solar cells to the light source.

6 Claims, 4 Drawing Figures

SOLAR POWERED TOY

This invention relates to a solar powered toy which moves several angularly related arms in a sequence which is not predetermined. When placed on a level surface exposed to light, the several arms turn and pivot to cause the toy to assume unusual shapes and configurations as it moves about on that surface. The arms of the device are provided with exposed solar cells which drive electric motors mounted within the arms. As the arms move, the amount of light absorbed by the solar cells changes and this produces an unusual sequence of movements of the angularly related arms of the device.

Other and more detailed objects and advantages will appear hereinafter.

Figure 1:
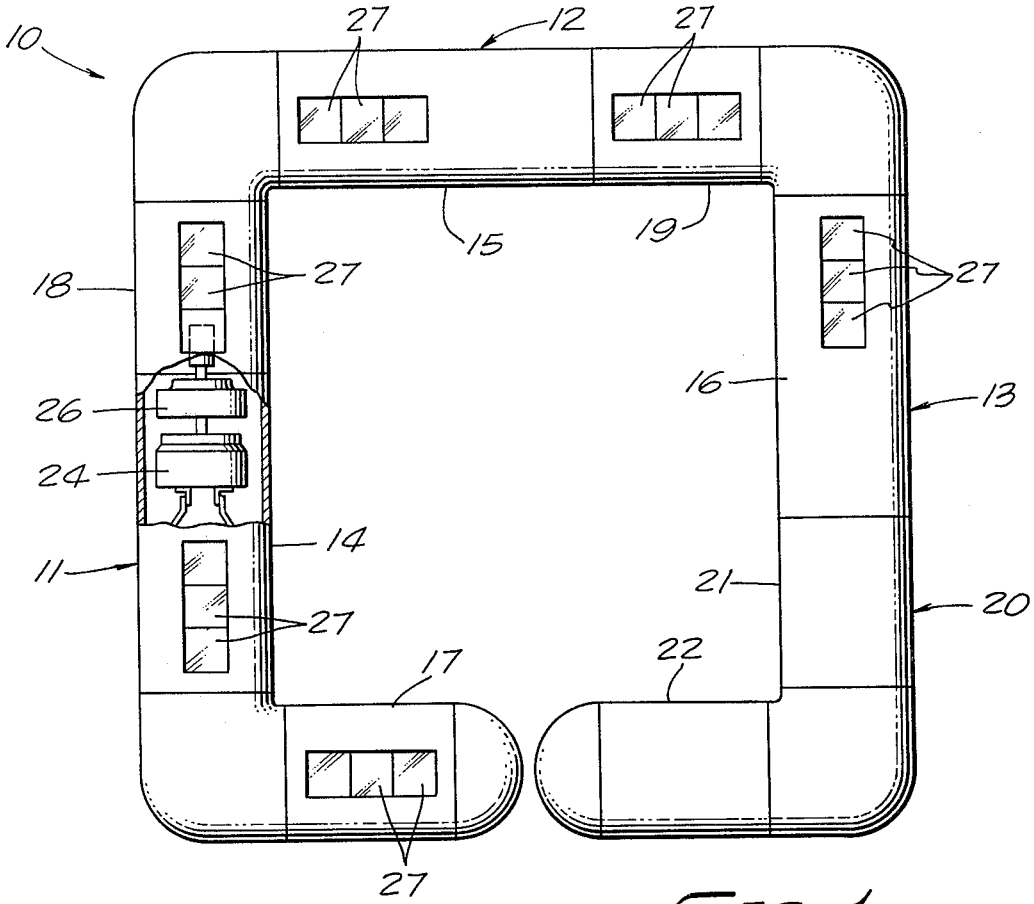
FIG. 1 is a schematic plan view of a preferred embodiment of a solar powered toy embodying this invention.
Figure 2:
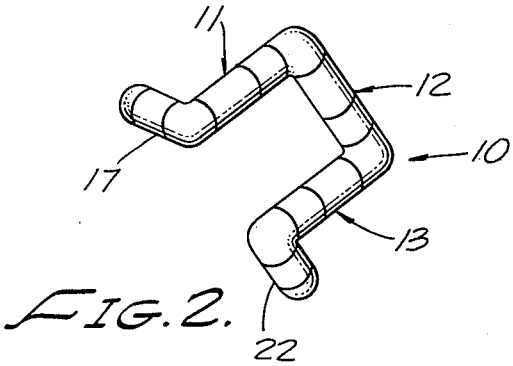
FIGS. 2, 3 and 4 are schematic perspective views showing the arms in several of many possible positions.
Figure 3:
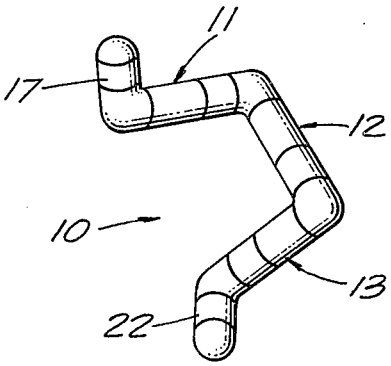
Figure 4:
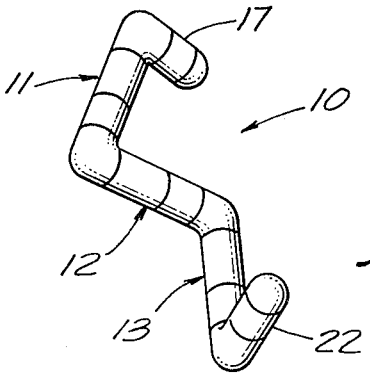

Referring to the drawings, the solar powered toy generally designated 10 has three "L"-shaped legs 11, 12 and 13 which are duplicates. Each has a long section 14, 15 and 16, respectively, fixed at right angles to a short section 17, 18 and 19, respectively. The fourth "L"-shaped leg 20 has two sections 21 and 22 which may be of similar lengths.

The long section 14 of the "L"-shaped leg 11 is aligned with and mounted for turning or pivotal movement with respect to the short section 18 of the "L"-shaped leg 12. Similarly, the long section 15 of the "L"-shaped leg 12 is aligned with and mounted for turning or pivotal movement with respect to the short section 19 of the "L"-shaped leg 13. Furthermore, the long section 16 of the "L"-shaped leg 13 is aligned with and mounted for turning or pivotal movement with respect to the short section 21 of the "L"-shaped leg 20.

The legs can be placed in the position shown in FIG. 1 in which they define a square.

An electric motor 24 is mounted within the long section 14 of the "L"-shaped leg 11 and is connected to turn the short section 18 of the "L"-shaped leg 12 through a reduction gear device 26. It will be understood that the torque developed by the motor 24 acting through the reduction gear device 26 applies a torque to the short section 18 in one direction while applying an equal and opposite torque to the long section 14, so that either or both may turn, depending upon the resistance encountered. Solar cells 27 are mounted in an exposed position on the "L"-shaped leg 11. A similar motor reduction gear device and solar cells are carried by the long section 15 of the "L"-shaped leg 12, for turning the short section 19. Also, a similar motor reduction gear device and solar cells are carried by the long section 16 of the "L"-shaped leg 13 for turning the short leg 21.

It will be understood that, as the relative positions of the "L"-shaped legs change, the angular position of the solar cells with respect to the light source also changes and this causes speed-up or slow-down in the relative motion between adjacent leg sections. On a level surface exposed to sunlight or artificial light, the toy continuously changes shape and turns over and "walks" along a path which is not predetermined. Moreover, it is a useful teaching device to show how orientation of the solar cells with respect to the light source causes accelerations and decelerations between adjacent moving parts.

Having fully described my invention, it is to be understood that we are not to be limited to the details herein set forth but that my invention is of the full scope of the appended claims.

I claim:

1. A solar powered toy including a plurality of legs each having a first section and an angularly related section, the legs being rotatably connected with adjacent legs, at least one of the legs having one section aligned with and pivotally connected to another section of an adjacent leg, means including an electric motor mounted in selected sections and each motor connected to turn the section of the adjacent leg, and solar cells mounted in an exposed position on at least one of said legs and connected to drive said electric motor.

2. A toy of claim 1 in which said sections of each leg are connected at right angles.

3. In a solar powered toy, the combination of: a plurality of legs each having angularly related sections, the legs being adjacently and rotatably connected together, means connecting at least one of the sections for relative turning movement, means including an electric motor mounted in selected sections connected to turn a section of an adjacent leg, and solar cells mounted in an exposed position on at least one of said legs and connected to drive said electric motor.

4. In a solar powered toy, the combination of: a plurality of "L"-shaped legs, selected legs being duplicates and each having one long section and one short section connected adjacently at right angles, said selected legs each having its long section aligned with and pivotally connected to a short section of an adjacent leg, means including an electric motor mounted in each long section connected to turn the short section of another adjacent leg, and solar cells mounted in a position exposed to light on each of said selected legs and connected to drive the electric motors mounted in each leg.

5. In a solar powered toy, the combination of: four "L"-shaped legs connected adjacently and rotatably end to end to form a square, three of said legs being duplicates of each other and each having one long section and one short section connected at right angles, said three legs each having its long section aligned with and pivotally connected to a short section of an adjacent leg, means including an electric motor mounted in each long section connected to turn the adjacent short section of another leg, and solar cells mounted in an exposed position on each of said three "L"-shaped legs and connected to drive the electric motor mounted in said leg.

6. The combination of claim 5 in which the fourth leg of said four "L"-shaped legs is turned by an adjacently rotatably connected leg, said fourth leg having no motor of its own.

* * * * *